US008809721B2

(12) United States Patent
Krätzschmar

(10) Patent No.: US 8,809,721 B2
(45) Date of Patent: Aug. 19, 2014

(54) QUENCHING ELEMENT, QUENCHING UNIT, QUENCHING AND PLUGGING UNIT, AND SWITCHING DEVICE

(75) Inventor: Andreas Krätzschmar, Ammerthal (DE)

(73) Assignee: Siemens Aktiengesellschaft, Munich (DE)

( * ) Notice: Subject to any disclaimer, the term of this patent is extended or adjusted under 35 U.S.C. 154(b) by 680 days.

(21) Appl. No.: 12/448,980

(22) PCT Filed: Jan. 15, 2008

(86) PCT No.: PCT/EP2008/050389

§ 371 (c)(1), (2), (4) Date: Jul. 17, 2009

(87) PCT Pub. No.: WO2008/087136

PCT Pub. Date: Jul. 24, 2008

(65) Prior Publication Data

US 2010/0059481 A1 Mar. 11, 2010

(30) Foreign Application Priority Data

Jan. 18, 2007 (DE) ..... 10 2007 002 723

(51) Int. Cl.
*H01H 9/34* (2006.01)

(52) U.S. Cl.
USPC ..... 218/150; 218/34

(58) Field of Classification Search
CPC ..... H01H 9/34; H01H 9/30; H01H 9/40; H01H 9/46; H01H 9/48; H01H 9/52; H01H 9/50; H01H 33/08; H01H 33/30
USPC ..... 218/15, 34–40, 147–151, 155–158; 335/201, 202
See application file for complete search history.

(56) References Cited

U.S. PATENT DOCUMENTS

| | | | | |
|---|---|---|---|---|
| 4,876,421 | A * | 10/1989 | Miller et al. | 218/150 |
| 5,581,063 | A | 12/1996 | Clark et al. | |
| 5,834,724 | A * | 11/1998 | Asakawa et al. | 218/36 |
| 6,242,707 | B1 * | 6/2001 | Mody et al. | 218/1 |
| 7,117,807 | B2 * | 10/2006 | Bohn et al. | 114/222 |
| 2002/0134758 | A1 | 9/2002 | Duggal et al. | |

FOREIGN PATENT DOCUMENTS

| | | |
|---|---|---|
| EP | 1 313 121 | 5/2003 |
| WO | WO 94/11894 | 5/1994 |
| WO | WO 9411894 A1 * | 5/1994 |
| WO | WO 2005/112060 | 11/2005 |

* cited by examiner

*Primary Examiner* — Amy Cohen Johnson
*Assistant Examiner* — Marina Fishman
(74) *Attorney, Agent, or Firm* — Harness, Dickey & Pierce, P.L.C.

(57) ABSTRACT

A plate-shaped quenching element for a quenching unit of a switching device is produced of an electrically and also magnetically conductive plastic. In a special embodiment, the plastic is composed of a flame retardant material. At least one embodiment relates to a quenching unit and a quenching and plugging unit having a plurality of such quenching elements. Furthermore, at least one embodiment of the invention relates to a switching device having such a quenching unit and/or such a quenching and plugging unit.

22 Claims, 4 Drawing Sheets

QUENCHING ELEMENT, QUENCHING UNIT, QUENCHING AND PLUGGING UNIT, AND SWITCHING DEVICE

PRIORITY STATEMENT

This application is the national phase under 35 U.S.C. §371 of PCT International Application No. PCT/EP2008/050389 which has an International filing date of Jan. 15, 2008, which designated the United States of America, and which claims priority on German patent application number DE 10 2007 002 723.2 filed Jan. 18, 2007, the entire contents of each of which are hereby incorporated herein by reference.

FIELD

At least one embodiment of the invention generally relates to a plate-shaped quenching element for a quenching unit of a switching device.

At least one embodiment of the invention also generally relates to a quenching unit and/or a quenching and plugging unit with a plurality of such quenching elements.

Finally, at least one embodiment of the invention generally relates to a switching device with at least one fixed contact piece and at least one movable contact piece that can be actuated by a trip unit, and with a quenching unit or quenching and plugging unit disposed in a region of a switching chamber of the switching device. Such a switching device can be a line circuit breaker, a power breaker or a motor circuit breaker for example.

BACKGROUND

Plate-shaped quenching elements have been known for a long time from the prior art. These are generally made from iron sheet and combined to form a quenching sheet package or a quenching unit. A quenching sheet package typically consists of around 5 to 20 quenching elements. In technical circles such plate-shaped quenching elements are also referred to as quenching sheets.

The quenching function of the quenching unit on the one hand requires the electrical and also the magnetic conductivity of the iron. Due to the magnetic conductivity an arc occurring when the main contacts of the switching device are opened is drawn into the quenching unit and quenched there. In other words the arc is moved away from the switching contacts to the quenching unit by the magnetic suction effect. When the arc enters the electrically conducting quenching sheets, it is divided into individual segments and new arc base points form on the quenching sheets. These have a significantly higher voltage requirement (typically 10-20 V) than the actual arc plasma, so that a current-limiting effect is initiated, as a result of which the arc quenches. Some of the quenching sheet material is also evaporated. The evaporation energy is drawn from the arc. A higher pressure also results in the quenching unit due to the vapor. Both effects bring about a greater arc voltage requirement for the arc and therefore improved current limiting or accelerated quenching of the arc. The voltage requirement necessary to quench the arc is typically approximately 1.5 to 2.5 times the mains voltage to be shut down by the switching device.

The disadvantage of this variant is that the current to be shut off in the event of a short circuit is relatively poorly limited due to the high electrical conductance of the iron or of ferromagnetic metals. The exiting metal vapor to some extent produces an improvement in the electrical conductivity of the arc plasma, which on the one hand disadvantageously reduces the voltage requirement of the plasma. On the other hand the residual conductivity of the plasma cannot be reduced sufficiently quickly as a result during the current zero and some instances of so-called re-ignitions result after the initial quenching of the arc, in other words the current circuit is as if closed again or later shut off.

A further disadvantage of ferrous quenching sheets is that they rust without surface treatment and this can result in a loss of function (either due to the coalescence of the quenching sheets due to rust bubbles or due to the electrical insulation of the rust). As a result quenching sheets have to be galvanically surface-refined for example. However this surface protection evaporates with the first short-circuit shut off so the problem occurs "anew" for further operation.

Such switching devices are correspondingly voluminous and complex in order to be able to cope with the high current strengths. The short-circuit current can be a multiple of a rated current to be switched operationally, such as 10 times up to 1000 times for example.

The use of plastics that emit large quantities of gas in the switching chamber is known from the prior art for short-circuit current limiting. To this end the plastics are provided with a flame retardant, e.g. aluminum hydroxide or magnesium hydroxide. In the event of arc contact the plastic decomposes and emits gas. The energy required for endothermic decomposition of the plastic is drawn from the plasma of the arc in this process. The release of gas results in a higher mass density or higher pressure in the plasma, with the result that heat can be drawn from the arc plasma more readily. The voltage requirement of the arc increases. The emitted decomposition gases thus have a significant current-limiting effect.

Because the plastic parts are in contact with the flame retardant in the switching contact region, decomposition of the plastic parts also takes place during operational switching. These disadvantageously emit gas prematurely, so that in some circumstances the current-limiting effect of the gas-emitting plastics is no longer ensured in the event of a short circuit.

The decomposition products can also be deposited on the switching contacts of the switching device. This disadvantageously results in an increase in the contact resistance and thus to an erroneous increase in the heating of the switching device.

So-called current-limiting polymer compounds, which are utilized in switching devices or are additionally connected in series, are also known from the prior art. Such a compound or such a polymer current-limiter can be connected directly in the current path or in the quenching circuit of the switching device.

The polymer current limiter has the task of increasing the switching capacity of the switching device used. In this process it remains in rated operation, in overload operation and in the cased of smaller short circuits inactive. Only in the case of larger short-circuit currents does the polymer compound intervene with a sudden resistance increase to limit the short-circuit current. The switching device therefore does not have to be designed for the maximum possible short-circuit current, just for the short-circuit current limited by the polymer compound.

One disadvantage of this is the additional space requirement for the incorporation of the polymer compound in the switching device.

It is also disadvantageous that the polymer compound is connected electrically in series and also produces an additional electrical power loss due to its path resistance even in rated or overload operation. Also with such current limiters that have to be activated thermally incorrect switching can result (early tripping), electrical loads such as motors are started frequently at short time intervals. The starting current flowing on starting here corresponds to approximately 6 to 10 times the rated current, so the polymer compound is heated significantly.

Such a polymer compound consists of an electrically non-conducting phase, the so-called matrix, and a conductive phase, in other words a filler material. Generally a plastic, in particular a thermoplastic, is used as the matrix and carbon black as the filler material. Metal particles or graphite can be used as an alternative to carbon black.

The three-dimensional arrangement of the filler material particles in a two-component system, consisting of the matrix and the filler material, is also referred to as a percolation network. Depending on the shape and distribution of the filler material particles there is a certain filler material concentration, from which a closed path of filler material particles results through the two-component system. The filler material concentration is also referred to as the percolation threshold. In other words a specific electrical conductivity value for the polymer compound can be predetermined by appropriate selection of the filler material concentration.

SUMMARY

At least one embodiment of the invention specifies an improved plate-shaped quenching element, an improved quenching unit and/or an improved quenching and plugging unit.

Finally, at least one embodiment of the invention specifies a switching device with an improved switching behavior in the event of a short circuit.

At least one embodiment is achieved by a plate-shaped quenching element for a quenching unit of a switching device. In at least one embodiment, a quenching unit with a plurality of inventive plate-shaped quenching elements is cited. In at least one embodiment, a switching device is indicated, which has an inventive quenching unit and/or an inventive quenching and plugging unit.

According to at least one embodiment of the invention, the quenching element is made from an electrically and also magnetically conductive plastic. This can also have an actively gas-emitting effect.

Since it is known that the electrical conductivity of such plastics is lower than that of metals, short-circuit current limiting is improved by way of a quenching element or by way of a plurality of inventive quenching elements. The magnetic conductivity of the plastic also ensures the magnetic suction effect of the arc occurring when the switching device is shut off toward the quenching element or the plurality of quenching elements.

According to a first embodiment, the quenching element is made from an electrically non-conductive plastic as the matrix with electrically and also magnetically conductive particles incorporated therein.

According to one embodiment, the particles have a volume percentage of 50% to 95%, in particular in a range from 70% to 90%, in the plastic material of the quenching element. The magnetically and also electrically conductive particles are in particular ferromagnetic particles.

Metals such as iron, nickel or cobalt and their alloys, such as nickel-cobalt alloys for example, are preferred. In particular the metal particles have lengths of up to 0.5 mm, preferably however in the range from 50 to 300 μm, at least in a spatial direction.

According to one embodiment, the plastic is a thermoplastic, in particular a polybutylene terephthalate or a polyoxymethylene.

Polybutylene terephthalate (abbreviated to PBT) is characterized by high rigidity and strength, very good dimensional stability in heat, low water absorption and good resistance to many chemicals. This plastic also has an excellent thermal ageing behavior.

Polyoxymethylene or polyacetal (abbreviated to POM) is characterized among other things by a high mechanical rigidity and strength, optimal dimensional stability and very good resistance to different chemicals.

According to one embodiment, the quenching element is made from an electrically conductive plastic as the matrix with magnetically conductive particles incorporated therein.

Conductive plastics per se are known from the prior art. Such plastics do not achieve their electrical conductivity through the addition of further electrically conducting materials such as metals, carbon black or graphite but through appropriate doping of electrically non-conducting polymers, in other words insulators. The reason for this is that the polymers completely lack the basic prerequisite for electrical conductivity, quasi-free electrons. By adding substances (doping), which for electron movement either supply electrons to the polymer chain (reduction) or create free spaces by removal (oxidation), it is possible to produce electrically conducting polymers.

Thus for example polyacetylene and poly(p-phenylene) become electrically conducting when they are doped with bromine, iodine or perchloric acid. A further possible electrically conducting polymer is polyaniline, doped with hydrochloric acid and polypyrrole from anodic oxidation.

According to one embodiment, the magnetically conductive particles have a volume percentage of 50% to 95%.

According to a further embodiment, the magnetically conductive particles are ferrites. Ferrites are ferromagnetic ceramic materials of iron oxide (hematite) ($Fe_2O_3$), rare magnetite ($Fe_3O_4$) and further metal oxides, which are poor electrical conductors or electrically non-conducting. Ferrites conduct the magnetic flux very well in the non-saturated instance. They have a relatively high permeability. The ferrites under consideration are preferably magnetically soft ferrites.

According to a further embodiment, the plastic preferably has a specific electrical conductivity in the range from $10^3$ to $10^6$ Siemens/meter. In other words the conductivity of the plastic used for the quenching element is one to two orders of magnitude below that of metals, in particular the ferrous metal generally used. The advantageously considerably lower conductivity means that considerable current-limiting of the arc is likewise possible. Nevertheless the specific electrical conductivity in the above-mentioned range from $10^3$ to $10^6$ Siemens/meter is extraordinarily high compared with undoped thermoplastics with conductivity values of significantly less than 1 mS/meter.

According to a further embodiment, the plastic has a relative magnetic permeability greater than 10. It is therefore one order of magnitude greater than that of the diamagnetic or paramagnetic materials. It is true that the relative magnetic permeability is relatively low compared with ferromagnetic materials, such as iron for example, with a relative permeability greater than 100. However this is totally adequate for an effective magnetic suction effect.

The plastic described above for a quenching element can also be a mixture of undoped and therefore non-conducting thermoplastic as well as a doped thermoplastic.

According to a preferred and particularly advantageous embodiment the plastic comprises a flame retardant, in particular with a volume percentage up to 10%. Depending on requirements the volume percentage can also be lower than this, for example up to 5%, or higher, for example between 10% to 20%.

The flame retardant is preferably a metal hydroxide, for example aluminum hydroxide or magnesium hydroxide.

Alternatively the flame retardant can be polybrominated diphenyl ether, tetrabromobisphenol or similar for example.

This has the particular advantage that the quenching element emits gas on arc contact. The outflowing gas causes sudden cooling of the arc, which has a powerful current-limiting effect up to the interruption of the arc.

The inventive quenching element of at least one embodiment can be produced by way of an extrusion and/or injection molding method. To this end a plastic granulate is preferably melted and mixed in an extruder to form a viscous mass. Extruders are conveyor devices which operate according to the functional principle of the Archimedes' screw to press solid to viscous masses at high pressure and high temperature out of a shaping opening in a uniform manner. The only magnetically or magnetically and electrically conducting particles described above and optionally the flame retardant are added to this plastic matrix. After mixing and homogenizing the plate-shaped quenching elements are injection molded.

According to one embodiment, the quenching element has an essentially rectangular shape. In particular it has a U-shaped or semicircular cutout. The cutout here is on the edge of one of the four sides of the quenching element. The cutout is embodied in such a manner that the arc entering the cutout strikes the quenching element in a uniform manner.

According to a further embodiment, the quenching element has a structured surface. This advantageously restricts the capacity of the arc for movement, so that it remains largely within the quenching unit. The quenching elements can be embodied in a corrugated manner for example. Alternatively or additionally they can have a variable quenching sheet thickness. They can also have elevations, recesses, webs and/or openings to change the flow behavior of the arc.

At least one embodiment of the invention is also directed to a quenching unit with a plurality of quenching elements disposed one above the other. This limits the current even more effectively in the event of a short circuit.

According to one embodiment, the quenching elements can be injected into a housing of a switching device by way of a plastic manufacturing method. The housing is made from an electrically non-conducting plastic and optionally from a magnetically conducting plastic. The plastic can also comprise a flame retardant.

There is then advantageously no need for assembly. In particular the mechanical strength of the switching device housing is increased in respect of an internal pressure loading due to the arc.

Alternatively the quenching unit can be formed from a plurality of quenching elements, which are held together in the lateral region by means of spacers. The spacers can be made from an electrically non-conducting plastic for example. Alternatively the spacers can be made from fiber glass or a ceramic.

The quenching unit itself can also have a housing, into which the quenching elements can be injected by way of a plastic manufacturing method. In this instance the housing is made from an electrically non-conducting plastic and optionally from a magnetically conducting plastic. The plastic can also comprise a flame retardant.

In one example embodiment the quenching unit can be produced as a single piece by means of a plastic manufacturing method. As a result the quenching unit can advantageously be produced in a single manufacturing step, for example in an injection mold.

According to one embodiment the quenching unit is multiphase, in particular 3-phase. Such a quenching unit is advantageously more compact than separately embodied quenching units.

In on particular embodiment the quenching unit has a phase quenching unit for each phase, which can be injected together into the switching device housing.

It is therefore not necessary to assemble such a quenching unit in a switching device. The rigidity of the housing is also substantially increased.

At least one embodiment of the invention is also directed to a quenching and plugging unit, which has an inventive quenching unit of at least one embodiment and a plugging unit that can be injected onto the quenching unit at the same time. The quenching and plugging unit is preferably produced by way of a plastic injection method.

The plugging unit serves to prevent the arc exiting through the rear of the quenching element. It is therefore disposed on a rear face of the quenching unit facing away from the incoming arc. The plugging unit represents a flow resistance for the arc with the result that the arc remains within the quenching unit and is ultimately extinguished there. The quenching unit can have openings or be configured as a labyrinth to increase the flow resistance.

According to one example embodiment the quenching and plugging unit can be produced in a (single) injection molding step. One possible manufacturing method is the so-called 1×2K plastic injection method. With the plastic method known per se different types of plastic are injected together into different regions of the injection mold and then become permanently connected to one another. The types of plastic required for the quenching unit and for the plugging unit are thus injected together into the injection mold. The plastic used to space the quenching elements is preferably the same as the one also used for the plugging unit. In particular this plastic is a non-conductive plastic, e.g. PBT or POM.

Alternatively the quenching and plugging unit can be produced by means of a so-called 2×1K plastic injection method. With the plastic method known per se different types of plastic are injection molded successively onto one another. In other words in a first injection molding step the quenching elements are produced for example, in a second injection molding step the housing or a number of spacers for the quenching unit are produced, among other things to connect the plurality of quenching elements permanently to one another and in a third step the plugging unit is injection molded onto the quenching unit. The last two steps can also be combined into a single step, particularly if one type of plastic is used both for the housing or spacers and also for the plugging unit.

A non-conductive material, in particular a plastic, e.g. PBT or POM, is used for the plugging part.

The object is finally achieved by a switching device with at least one fixed contact piece and at least one movable contact piece that can be actuated by a trip unit, and with an inventive quenching unit of at least one embodiment or inventive quenching and plugging unit of at least one embodiment disposed in a region of a switching chamber of the switching device.

The quenching unit or quenching and plugging unit produced by way of the method described above can be produced in large numbers and in a potentially simple manner from a manufacturing point of view. There is therefore no need for the complex assembly of the quenching unit or the quenching and plugging unit hitherto required from the plurality of quenching sheets, which then have to be combined to form a quenching sheet package. The separate attachment of the plugging unit to the quenching unit is also no longer necessary.

One further advantage is the lighter weight of at least one embodiment of the inventive quenching elements or the quenching unit due to the lower specific gravity of the plastics used compared with the conventionally used heavy iron sheet.

Such a switching device can be embodied in a particularly compact manner due to the active current limiting by way of the inventive quenching unit of at least one embodiment or quenching and plugging unit of at least one embodiment. The lighter-weight quenching unit or quenching and plugging unit means that the weight of the inventive switching device is also advantageously lighter.

A further advantage of at least one embodiment is the increased functional reliability of such a switching device, since the quenching unit or quenching and plugging unit is not disposed in the direct contact region of the switching contacts of the switching device. Other premature gas emission by the quenching elements due to the adjacent switching contacts that become hot during the switching operation can advantageously be avoided as a result.

BRIEF DESCRIPTION OF THE DRAWINGS

The invention and advantageous embodiments of the invention are described in more detail below with reference to the accompanying figures, in which.

DETAILED DESCRIPTION OF THE EXAMPLE EMBODIMENTS

Figure 1:
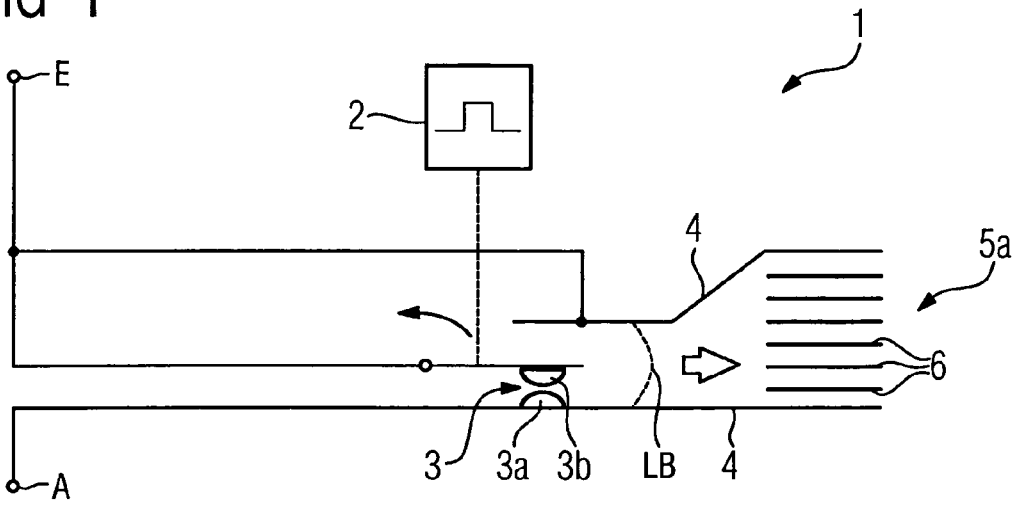
FIG. 1 shows an example structure of a switching device according to the prior art.

FIG. 1 shows an example structure of a switching device 1 according to the prior art.

The electrical connectors E, A, i.e. the input E and output A, of the switching device 1 are shown in the left part of FIG. 1. The main contacts 3, consisting of a fixed contact piece 3*a* and a movable contact piece 3*b*, are shown roughly in the center of the diagram. The movable contact piece 3*b* can be pivoted to open the main contacts 3 according to the marked arrow direction by means of a trip unit 2, for example by means of a control magnet, in the detected event of an overcurrent or short circuit.

The reference character LB indicates an arc, which, in particular in the event of a short circuit, runs to the right in the direction of a further marked arrow and there meets a quenching unit 5*a*. The arc LB runs along guide rails 4, which are connected electrically to the quenching unit 5*a*. In the example in FIG. 1 the quenching unit 5*a* consists of a plurality of quenching sheets 6, which are combined to form a package of iron sheets.

Figure 2:
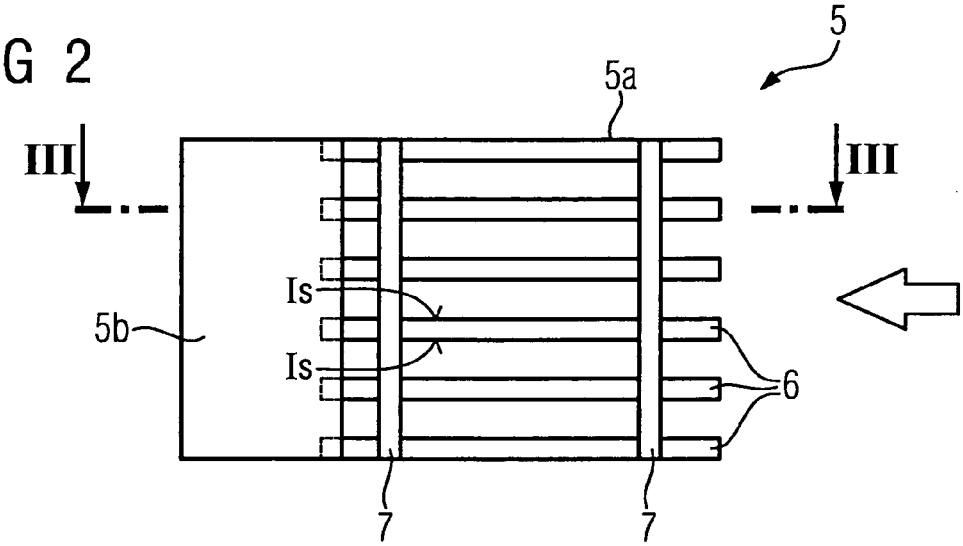
FIG. 2 shows an example side view of a quenching and plugging unit from the side according to the prior art.

FIG. 2 shows an example side view of a quenching and plugging unit 5 from the side according to the prior art.

The arrow shows the direction of movement of the arc LB. Six quenching sheets 6 are shown by way of example, being held together in the lateral region by way of two spacers 7 in each instance to form a sheet package, in other words to form the quenching unit 5*a*. The arc LB running into the quenching unit 5*a* is then cooled on the inner faces IS of the quenching unit 5*a*, in other words on the outer faces of the quenching sheets 6. The resulting increased voltage requirement of the arc LB results in the extinguishing and thus the interruption of the switching current.

The reference character 5*b* indicates a plugging unit. It includes typically an electrically non-conducting plastic, a ceramic or fiber glass and prevents the arc LB exiting from the quenching unit 5*b*.

Figure 3:
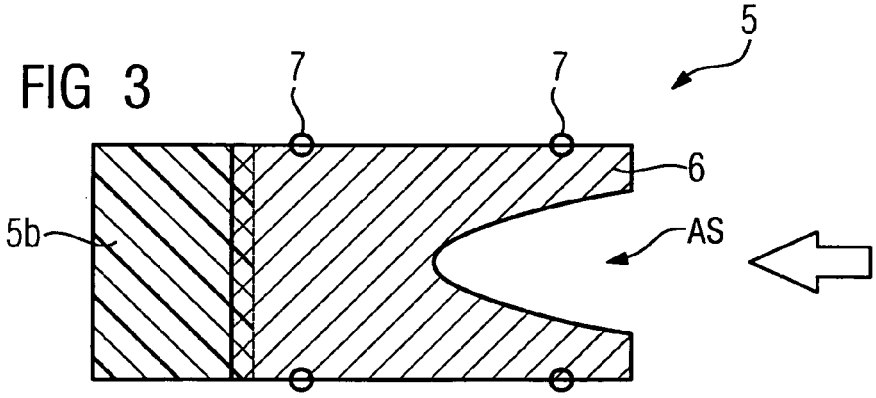
FIG. 3 shows a cross-sectional diagram of the quenching and plugging unit according to FIG. 2 through a quenching sheet along the section line III-III marked in FIG. 2.

FIG. 3 shows a cross-sectional diagram of the quenching and plugging unit 5 according to FIG. 2 through a quenching sheet 6 along the section line III-III marked in FIG. 2.

This diagram shows a U-shaped cutout AS, which is tailored geometrically to the front of the profile of the arc LB as it arrives in the quenching unit 5*a*. The cutout AS can also be semicircular or have a different geometrically suitable shape.

Figure 4:
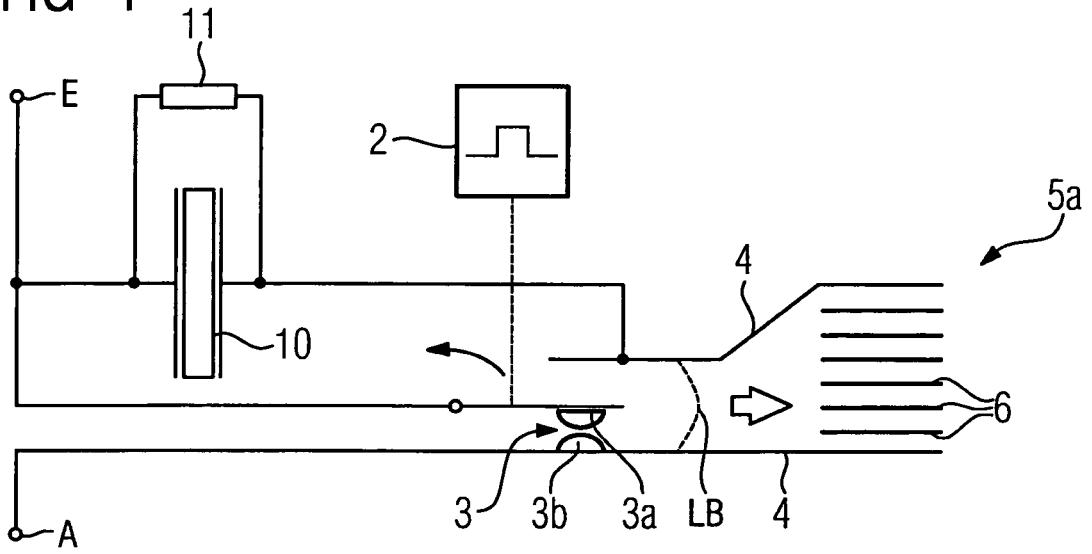
FIG. 4 shows an example structure of a switching device with a current-limiting polymer compound according to the prior art.

FIG. 4 shows an example structure of a switching device 1 with a current-limiting polymer compound 10 according to the prior art.

In the case of the switching device 1 shown the polymer compound or polymer current limiter 10 is connected in the current path, when the arc LB runs along the guide rails 4. The reference character 11 indicates a limiting resistance connected parallel thereto. In the event of a short circuit the polymer compound 10 suddenly increases its resistance, thereby limiting the current rise in the switching device 1.

Figure 5:
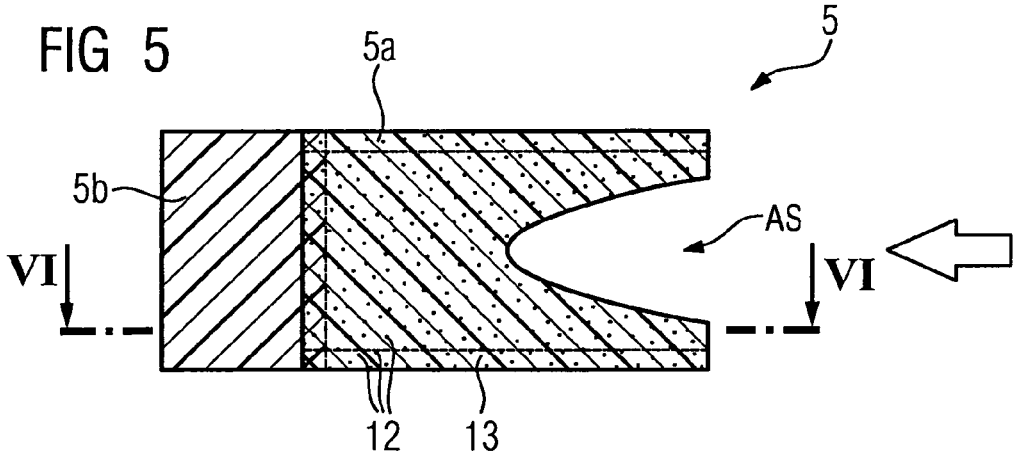
FIG. 5 shows an example plan view of a sectional diagram through an embodiment of an inventive quenching unit or an embodiment of inventive quenching and plugging unit.

FIG. 5 shows an example plan view of a sectional diagram through an inventive quenching unit 5*a* or through an inventive embodiment of the quenching and plugging unit 5.

FIG. 5 shows a plate-shaped quenching element 6 for a quenching unit 5*a* of a switching device 1. In the example in FIG. 5 the plate-shaped quenching element 6 has a rectangular shape with a U-shaped cutout AS. To change the flow behavior the plate-shaped quenching elements can also have a structured surface.

According to an example embodiment of the invention, the quenching element 6 is made from an electrically and also magnetically conductive plastic. The electrically non-conductive plastic forms a matrix 13, in which electrically and also magnetically conductive particles 12 are incorporated. The particles 12 are shown as small dots in the example in FIG. 5. They can have a volume percentage of 50% to 95% here. The particles 12 mentioned can be metallic particles 12, for example iron, cobalt, nickel particles. They can also be alloys thereof. The plastic or matrix 13 is then preferably a thermoplastic, in particular a polybutylene terephthalate (=PBT) or a polyoxymethylene (=POM).

Alternatively or additionally an electrically conducting plastic, e.g. doped polyacetylene, polyphenylene or polyaniline, can be used as the matrix 13 instead of the electrically non-conducting plastic. Only magnetically conducting particles 12, in other words essentially electrically non-conducting particles 12, can be incorporated in the plastic instead of the electrically and also magnetically conducting particles 12. The necessary electrical conductivity of the quenching element 6 is in this instance furnished by the electrically conductive plastic itself. The predominantly only magnetically conducting particles 12 are in particular ferrites. Their volume percentage in the plastic material is in a range from 50% to 95%.

Both the above-mentioned embodiments, in which an electrically conducting or an electrically non-conducting plastic is used as the matrix 13, can also be combined with one another. In particular the plate-shaped plastic quenching elements 6 ultimately produced have a specific electrical conductivity in the range from $10^3$ to $10^6$ Siemens/meter. The relative permeability describing the magnetic conductivity of the plastic has a value greater than 10, for example 100.

In addition to the magnetically conducting particles 12, which can at the same time also be electrically conducting, a flame retardant can also be incorporated in the plastic matrix 13, in particular with a volume percentage up to 10%. The flame retardant is in particular a metal hydroxide, for example aluminum hydroxide. In the example in FIG. 5 the incorporated flame retardant is not shown graphically for reasons of clarity.

A sectional diagram of a plugging unit 5*b* made from an electrically non-conductive plastic such as PBT or POM is shown in the left part of FIG. 5. It therefore has no electrically conducting and magnetically conducting particles 12. The plugging unit typically but not necessarily comprises no flame retardant.

In the example in FIG. 5 the combined quenching and plugging unit shown is produced in a single injection molding step, in other words as a single piece, for example by way of a 1×2K plastic injection molding method.

Alternatively the quenching unit 5*a* can have a housing, in which the inventive quenching elements 6 are inserted with space between them. The housing is made from an electrically non-conducting and optionally magnetically conductive material, in particular from a plastic.

Also alternatively, an embodiment of the inventive plate-shaped quenching elements 6 can also be held together by way of electrically non-conducting spacers. These are preferably disposed in a lateral direction in relation to the direction of travel of the arc LB, in other words on the lateral edge of the quenching elements 6.

Alternatively a quenching unit 5*a* can also be produced in such a manner that the quenching elements 6 are injected directly into the housing of the quenching unit 5*a*. The housing can be made from plastic or from a ceramic for example.

Figure 6:
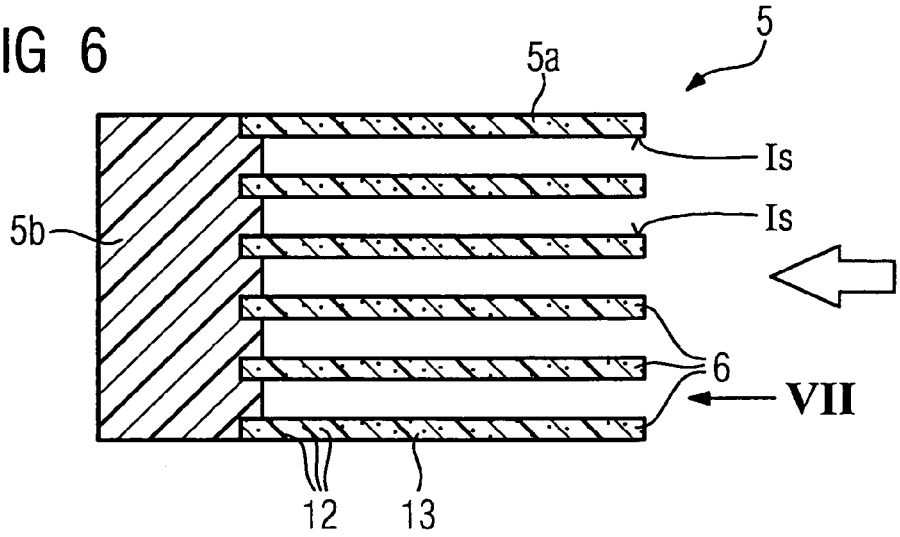
FIG. 6 shows a sectional diagram of the quenching unit or quenching and plugging unit according to FIG. 5 along the section line VI-VI marked in FIG. 5.

FIG. 6 shows a sectional diagram of the quenching unit 5*a* or the quenching and plugging unit 5 according to FIG. 5 along the section line VI-VI marked in FIG. 5.

As shown in FIG. 6, the quenching elements 6 are at an identical distance from each other. The distance is typically in the millimeter range. In this sectional diagram the retaining walls 5*c* (see FIG. 7 below), which hold the quenching elements apart and which are preferably made from the same plastic as the plugging unit 5*b*, are not visible.

Figure 7:
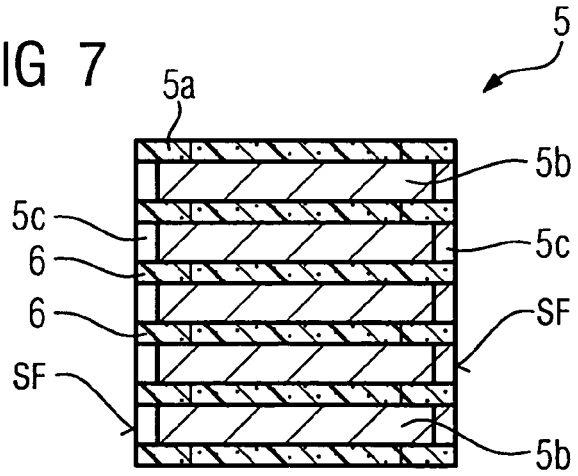
FIG. 7 shows a front view of the quenching unit or quenching and plugging unit according to FIG. 5 and FIG. 6 according to the viewing direction VII marked in FIG. 6.

FIG. 7 shows a front view of the quenching unit 5*a* or the quenching and plugging unit 5 according to FIG. 5 and FIG. 6 according to the viewing direction VII marked in FIG. 6.

This diagram in particular shows the compact structure of an embodiment of the inventive quenching and plugging unit 5. The quenching elements 6 are held together by way of retaining webs 5*c* or retaining walls 5*c*, which are configured on the lateral surfaces SF of the quenching unit 5*a*.

Figure 8:
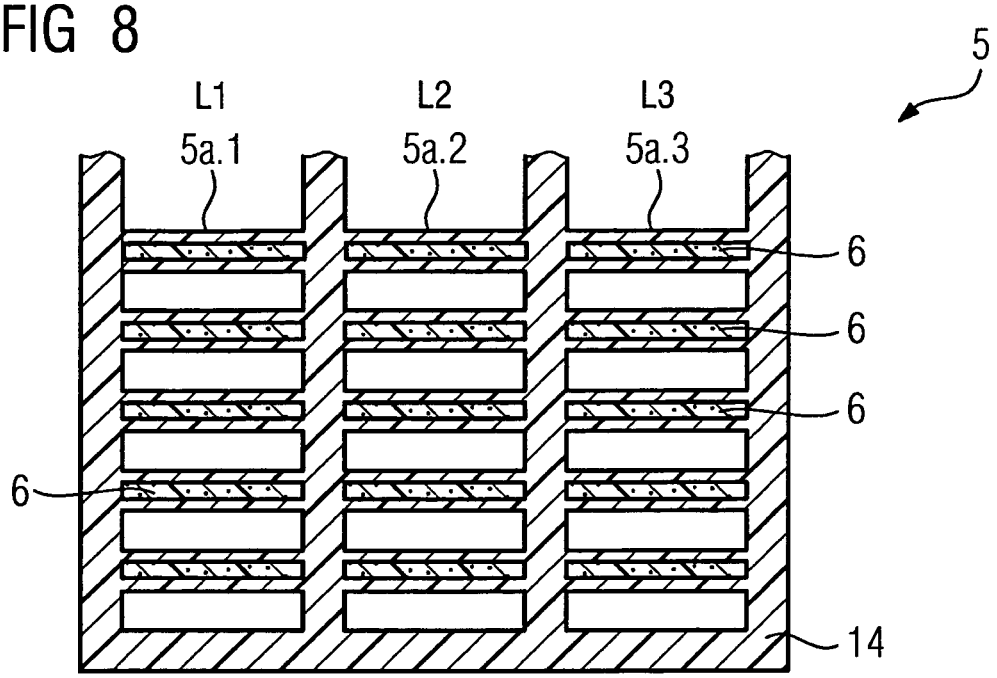
FIG. 8 shows a sectional diagram through a multi-pole quenching and plugging unit according to an embodiment of the invention injected into a housing of a switching device and FIG. 9 shows a plan view of an embodiment of the inventive quenching and plugging unit according to FIG. 8.

FIG. 8 shows a sectional diagram through a multi-phase quenching and plugging unit 5 according to an embodiment of the invention injected into a housing 14 of a switching device 1.

The reference characters L1 to L3 indicate examples of three phases of a three-phase or three-pole switching device 1. According to an embodiment of the invention, the quenching unit 5 has a phase quenching unit 5*a*.1-5*a*.3 for each phase L1-L3, which can be injected together into the switching device housing 14.

The switching device housing 14 here is made from an electrically non-conducting material, in particular a plastic.

An embodiment of the inventive quenching elements 6 injected into the switching device housing 14 are disposed in such a manner that they are spaced within the respective phase quenching units 5*a*.1-5*a*.3. Hollow spaces (not shown in more detail here), through which the arc LB can pass, are formed between the quenching elements 6 of a phase L1-L3. The electrically and also magnetically conducting quenching elements 6 are also disposed in an electrically insulating manner in relation to quenching elements 6 of adjacent phase quenching units 5*a*.1-5*a*.3.

Figure 9:
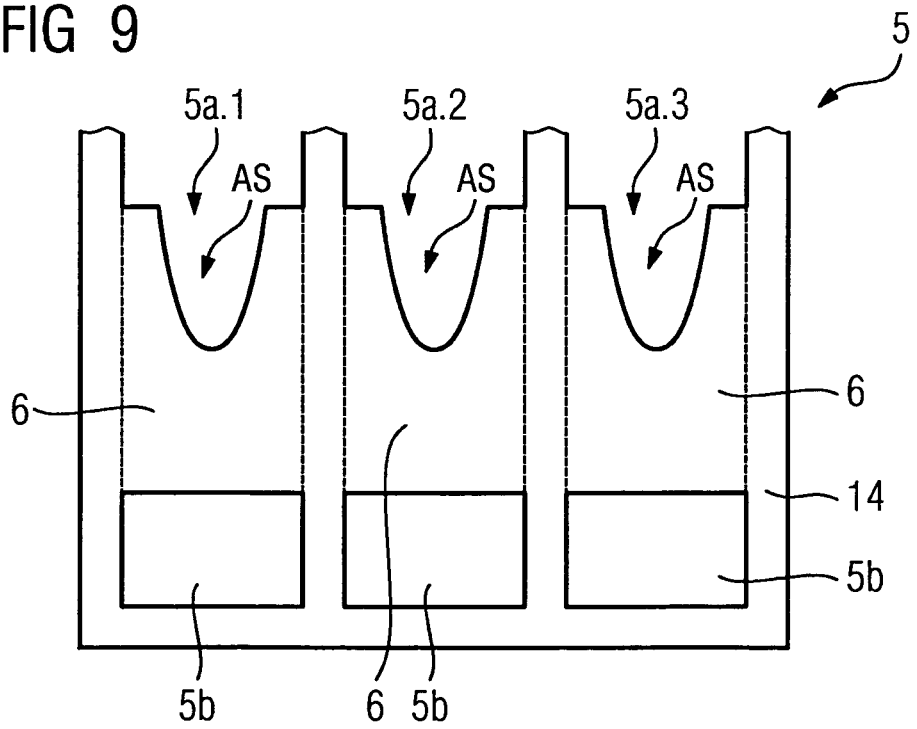

FIG. 9 shows a plan view of an embodiment of the inventive quenching and plugging unit 5 according to FIG. 8. In this diagram the electrically insulating arrangement of the quenching elements 6 in relation to quenching elements 6 of adjacent phase quenching units 5*a*.1-5*a*.3 is clearly visible.

The reference character 5*b* indicates hollow spaces, which by way of example respectively form a plugging unit 5*b* for the respective phase L1-L3. They can therefore also be considered as phase plugging units.

Generally, in addition to an embodiment of an inventive quenching unit 5*a* or an embodiment of an inventive quenching and plugging unit 5 disposed in a region of a switching chamber of the switching device 1, a switching device 1 according to an embodiment of the invention has at least one fixed contact piece 3*a* and at least one movable contact piece 3*b* that can be actuated by a trip unit 2. The quenching unit 5*a* and the quenching and plugging unit 5 are connected electrically to guide rails 4, which for their part lead to the electrical connectors E, A of the switching device 1.

To summarize a plate-shaped quenching element 6 for a quenching unit of a switching device can be produced from an electrically and also magnetically conductive plastic. In one particular embodiment the plastic comprises a flame retardant. An embodiment of the invention relates to a quenching unit as well as a quenching and plugging unit with a plurality of such quenching elements. An embodiment of the invention also relates to switching device with such a quenching unit or such a quenching and plugging unit.

One particular feature of an embodiment of the invention is the electrical and also magnetic conductivity of the plastic quenching elements. The gas-emitting effect at the same time here is more efficient than the evaporation of a conventionally used iron sheet to increase the arc voltage and to prevent re-ignition. The lower electrical conductivity compared with iron or metals generally improves the current-limiting effect considerably. A further major advantage is the significantly simplified manufacture of the quenching unit or the combined quenching and plugging unit. They can now be produced as a single piece, with the plugging unit and further parts, for example for securing purposes, being injected on at the same time. The improved oxidation behavior means that a refining surface treatment, as is the case with conventional quenching sheets, is not necessary. The greater diversity in respect of shaping that is generally possible by way of the plastic manufacturing method means that more complex structures of the quenching or quenching and plugging unit that are more favorable with regard to incorporation are possible. The application of surface structures on the plate-shaped quenching elements, having a favorable influence on arc travel behavior, is simplified considerably.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A plate-shaped quenching element for a quenching unit of a switching device, the quenching element being made from a conductive thermoplastic including conductive and magnetic particles, the thermoplastic being one of a doped polyacetylene, polyphenylene and polyaniline, the thermoplastic having a specific electrical conductivity in the range from $10^3$ to $10^6$ siemens/meter throughout the quenching element, wherein the thermoplastic has a relative magnetic permeability greater than 10.

2. The quenching element as claimed in claim 1, wherein the particles have a volume percentage of 50% to 95% in the thermoplastic.

3. The quenching element as claimed in claim 1, wherein the conductive and magnetic particles are ferromagnetic particles.

4. The quenching element as claimed in claim 3, wherein the particles are metallic iron, cobalt, nickel particles or alloys thereof.

5. The quenching element as claimed in claim 1, wherein the magnetic particles are ferrites.

6. The quenching element as claimed in claim 1, wherein the thermoplastic includes a flame retardant.

7. The quenching element as claimed in claim 6, wherein the flame retardant is a metal hydroxide.

8. The quenching element as claimed in claim 1, wherein the quenching element has an essentially rectangular shape with a U-shaped cutout.

9. The quenching element as claimed in claim 1, wherein the quenching element has a top surface, a bottom surface, and a side surface connecting the top and bottom surfaces, and at least one of the top and bottom surfaces is a structured surface, the structured surface having at least one of a corrugated structure, an elevated structure, a recessed structure, a webbed structure, and a structure having openings.

10. A quenching unit with a plurality of quenching elements as claimed in claim 1, disposed one above the other.

11. The quenching unit as claimed in claim 10, wherein the quenching elements are injectable into a housing of a switching device via a plastic manufacturing method.

12. The quenching unit as claimed in claim 10, wherein the quenching unit has a housing, into which the quenching elements are injectable via a plastic manufacturing method.

13. The quenching unit as claimed in claim 10, wherein the quenching unit is configured as multi-phase.

14. The quenching unit as claimed in claim 13, wherein the quenching unit has a phase quenching unit for each phase, injectable together into the switching device housing.

15. A quenching and plugging unit comprising a quenching unit as claimed in claim 12 and a plugging unit, injectable onto the quenching unit at the same time.

16. The quenching and plugging unit as claimed in claim 15, wherein the quenching and plugging unit is produceable in one injection molding step.

17. The quenching and plugging unit as claimed in claim 15, wherein the plugging unit is made from an electrically non-conductive plastic.

18. A switching device, comprising:

at least one fixed contact piece;

at least one movable contact piece, actuateable by a trip unit; and a quenching unit as claimed in claim 10, disposed in a region of a switching chamber of the switching device.

19. The quenching element as claimed in claim 2, wherein the conductive and magnetic particles are ferromagnetic particles.

20. The quenching element as claimed in claim 19, wherein the particles are metallic iron, cobalt, nickel particles or alloys thereof.

21. The quenching element as claimed in claim 6, wherein the thermoplastic includes a flame retardant with a volume percentage up to 10%.

22. A switching device, comprising:

at least one fixed contact piece;

at least one movable contact piece, actuateable by a trip unit; and a quenching and plugging unit as claimed in claim 15, disposed in a region of a switching chamber of the switching device.

* * * * *